US006447137B1

(12) United States Patent
Long

(10) Patent No.: US 6,447,137 B1
(45) Date of Patent: Sep. 10, 2002

(54) ILLUMINATED WATERFALL LAMP

(76) Inventor: James David Long, 6923 E. Grand Ave., Dallas, TX (US) 75223

( * ) Notice: Subject to any disclaimer, the term of this patent is extended or adjusted under 35 U.S.C. 154(b) by 0 days.

(21) Appl. No.: 09/453,997

(22) Filed: Dec. 3, 1999

(51) Int. Cl.[7] ..... F21V 33/00

(52) U.S. Cl. ..... 362/96; 362/101; 362/222; 362/234; 362/240; 362/300; 362/318; 40/406; 40/442; 239/17; 239/18; 446/159

(58) Field of Search ..... 362/96, 101, 221, 362/222, 300, 318, 347, 351, 234, 240, 806; 40/406, 407, 409, 429, 442; 239/16, 17, 18; 446/156, 159, 164

(56) References Cited

U.S. PATENT DOCUMENTS

| | | | | |
|---|---|---|---|---|
| 3,390,665 A | * | 7/1968 | Wininger | 119/254 |
| 3,644,726 A | * | 2/1972 | Pfeuffer | 240/10 R |
| 3,814,317 A | | 6/1974 | Hruby, Jr. | |
| 3,901,439 A | | 8/1975 | Willis | |
| 4,020,337 A | | 4/1977 | Chatten | |

(List continued on next page.)

OTHER PUBLICATIONS

Breton, Pamela; "Waterfalls and Fountains for Whatever Delights You;" Table Delights; web page; Feb. 2, 1999; pp. 1–3; http://www.mallnbeyond.com/tdelight.

Action Agency; The Waterfall Lamp; web page; Feb. 4, 1999; pp. 1–5; http://home.earthlink.net/~actionagency.

Magic Mushroom Lamp & Waterfall Co.; Limited Edition Waterfall; web page; Feb. 2, 1999; pp. 1–2; http://www.magicmushroomlamps.com/cgi–local/shpo.p1/page=460wf, html/SID=106715462665.

Magic Mushroom Lamp & Waterfall Co.; Model #410 waterfall; web page; Feb. 2, 1999; pp. 1–2; http://www.magicmushroomlamps.com/cgi–local/shpo.p1/page=410wf-.html/SID=106819012446.

Magic Mushroom Lamp & Waterfall Co.; Model #330 waterfall; web page; Feb. 2, 1999; pp. 1–2; http://www.magicmushroomlamps.com/cgi–local/shpo.p1/page=330wf-.html/SID=106919469241.

Magic Mushroom Lamp & Waterfall Co.; Volcanic Waterfall; web page Feb. 2, 1999; pp. 1–2; http://www.magicmushroomlamps.com/cgi–local/shpo.p1/page=volcanic.ht.../SID=10701942067.

Magic Mushroom Lamp & Waterfall Co.; About Our Company; web page; Feb. 2, 1999; pp. 1–2; http://www.magicmushroomlamps.com/cgi–local/shpo.p1/page=about.html/SID=107119417835.

Magic Mushroom Lamp & Waterfall Co.; A Unique Collection Of Magic Mushroom Lamps & Waterfalls; web page; Feb. 2, 1999; pp. 1–1; http://www.magicmushroomlamps.com/cgi–local/shpo.p1/page=magic.html/SID=107119417835.

*Primary Examiner*—Stephen Husar
*Assistant Examiner*—Bertrand Zeade
(74) *Attorney, Agent, or Firm*—Daniel W. Keene; Akin, Gump, Strauss, Hauer & Feld, LLP

(57) ABSTRACT

A lamp illuminates a waterfall from behind as a liquid cascades down the outside of a housing into a basin. From the basin, the liquid flows through a cavity in the housing, behind a body and through a pump, through an outflow line, through a cap with filter, and into a liquid retainer at the top of the body. The liquid retainer overflows, allowing the liquid to cascade down the outside of the body and back into the basin for recirculation. The enclosure comprises alternating opaque and translucent bands. A light source within the cavity behind the enclosure illuminates an inside surface of the body with the translucent bands transmitting light through the cascading liquid, producing an appealing visual effect.

5 Claims, 4 Drawing Sheets

U.S. PATENT DOCUMENTS 4,101,424 A 7/1978 Schooley
4,294,406 A 10/1981 Pevnick
4,662,720 A 5/1987 Fergason
4,749,126 A 6/1988 Kessener
4,807,565 A 2/1989 Hawthorne
4,920,465 A 4/1990 Sargent
5,067,060 A 11/1991 Sieracki
5,165,777 A 11/1992 Kira
5,167,368 A * 12/1992 Nash ..... 239/17
5,282,438 A 2/1994 McLaughlin
5,420,765 A * 5/1995 Nordeen et al. ..... 362/96
5,571,409 A 11/1996 Scarborough
5,775,260 A * 7/1998 Jansen ..... 119/246
5,775,586 A 7/1998 Hamilton-Bruzzi
5,785,407 A 7/1998 Ratcliffe

* cited by examiner

ILLUMINATED WATERFALL LAMP

FIELD OF THE INVENTION

This invention relates to decorative lighting. In one aspect, it relates to an uncomplicated and inexpensive lamp that includes a self-contained waterfall illuminated by a light source.

BACKGROUND

It is well known to provide light in connection with flowing water or other liquid to produce an attractive visual effect. Lighted fountains, artificial decorative waterfalls, aquarium waterfall assemblies, and ornamental bubble lamps are examples of products which produce visual effects. These devices typically either illuminate the liquid from the front, incorporate electric lamps that are immersed in the basin which contains the liquid, or provide the effect of flowing liquid in a manifestation other than that of a waterfall. Often these devices are either both fairly large and elaborate or incorporate a significant number of parts. These devices usually do not utilize self-contained systems to circulate the liquid.

For example, U.S. Pat. No. 5,165,777, issued to Hiroshi Kira on Nov. 24, 1992 describes an illuminated fountain that includes a housing with a water chamber connected to an external water source. The water chamber has a cap with perforations, through which the water flows upwardly to create a fountain spray, and a transparent bottom panel. A lamp is directed to a reflector which reflects light through the transparent bottom panel, illuminating both the water in the chamber and the water flowing through the perforations, producing a lighted spray.

U.S. Pat. No. 3,901,439 issued to Lovell J. Willis on Oct. 12, 1973 discloses a portable miniature waterfall formed of plastic. The waterfall includes a hollow simulated rock formation mounted on a solid base that contains a shallow basin. The cavity inside the simulated rock formation contains a water pump connected by a hose to the top of the formation. The hose discharges the water, which cascades down the simulated rock formation into the basin for recirculation. A light source is mounted at the base of the simulated rock formation to illuminate the water as it falls into the basin.

In U.S. Pat. No. 5,571,409 issued on Nov. 5, 1996, Jerry L. Scarborough teaches an aquarium waterfall assembly that may be placed on top of a single aquarium tank and used to move water from the tank, over a decorative waterfall surface, and back into the tank. The water from the tank moves upwardly behind the waterfall surface through inflow lines, through a pump, and into a pump reservoir. The water near the top of the pump reservoir moves horizontally through outflow lines, then through distribution tubes to the top of the decorative waterfall surface, then down the waterfall surface into a tray, and then back into the aquarium tank. A light source, in a housing mounted in front of the waterfall surface, illuminates the falling water.

U.S. Pat. No. 4,020,337 issued to Victor H. Chatten on Apr. 26, 1977 describes an ornamental bubble lamp employing bubbles that rise in transparent tubes filled with liquid. The upwardly extending tubes contain an electrically non-conductive liquid under a partial vacuum. A heater at the lower end of each tube causes bubbles to form, pass through a restriction, and ascend in the liquid. Within each tube, a series of electric lamps, spaced at intervals above the restriction, supply additional heat and prevent condensation of the bubbles as the bubbles ascend. The lamps also illuminate the bubbles and produce a twinkling effect as each bubble passes one of the lamps.

However, none of these patents disclose a system which illuminates the liquid from behind a waterfall or similar liquid curtain and thus providing the illusion that the light source is submerged in the liquid while providing a dry lighting source.

SUMMARY OF THE INVENTION

The present invention is a decorative lighting device. In accordance with one aspect of the invention, a decorative lamp circulates a liquid which is illuminated from behind a waterfall or similar curtain as it flows down the outside of an upwardly projecting housing and into a basin. The housing including a body, a top, and a cavity formed by the body and top. The liquid flows from a basin to the top of the housing through a liquid circulation assembly which includes a pump, an outflow line, a cap with filter, and a liquid retainer. The liquid in the shallow basin enters an inlet port of the pump and is pumped through an outlet port into the outflow, upwardly through the outflow line, through the cap with filter, which is positioned below the decorative shade but above the liquid retainer, and into the liquid retainer, which is positioned above the illuminated enclosure. The liquid fills the liquid retainer, overflows, cascades down the outside of the illuminated enclosure under the decorative shade, and falls back into the shallow basin for recirculation.

In accordance with another aspect of the invention, a decorative lighting device is provided with a housing which includes alternating opaque and translucent bands. A light source, positioned inside the cavity behind the body, comprises at least one electric lamp connected to an electrical cord which may in turn be connected to an external power source. The electric lamp, which is positioned behind the opaque bands, illuminates the interior surface of the body. The translucent bands transmit light through cascading liquid, producing an appealing visual effect.

A better understanding of the present invention can be obtained when the following detailed description of exemplary embodiments are considered in conjunction with the following drawings, in which:

DETAILED DESCRIPTION OF EXEMPLARY EMBODIMENTS

Figure 1:
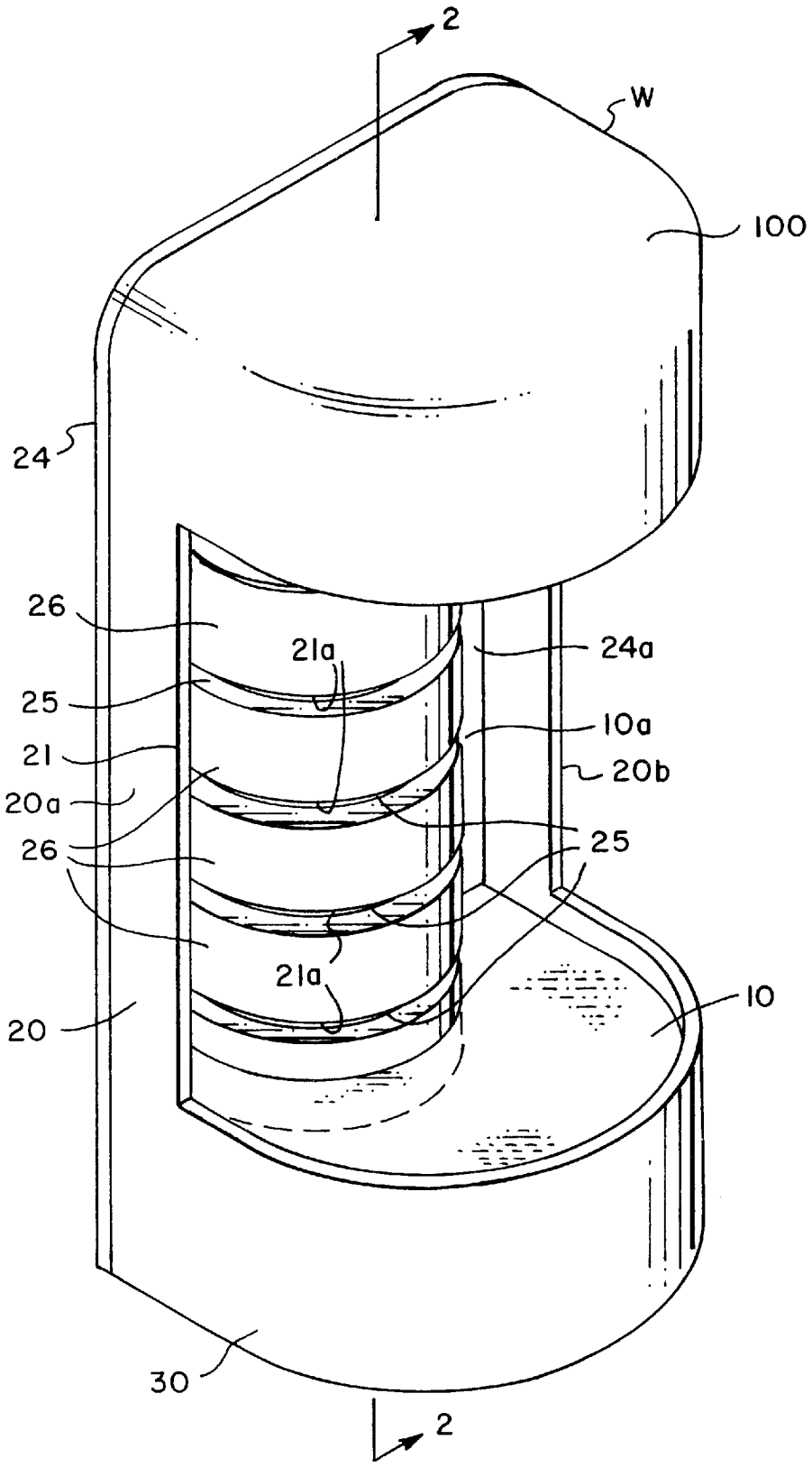
FIG. 1 is a perspective view of a first embodiment of the present invention.

In the description that follows, like parts are marked throughout the specification and drawings with the same reference numerals, respectively. The drawing figures are not necessarily drawn to scale and certain figures may be shown in exaggerated or generalized form in the interest of clarity and conciseness.

FIGS. 1, 2, 3, and 4 illustrate one embodiment of the invention. A waterfall lamp W is shown including a basin 30 and a generally semi cylindrical housing 20 extending upwardly from the basin 30. The housing 20 includes a hollow body 21, a dome shaped top 100, sidewalls 20*a* and 20*b*, a generally planar back wall 24, and an intermediate wall 24*a* spaced therefrom. Walls 24 and 24*a* extend between basin 30 and top 100. In one embodiment, the body 21 may have a cylindrical shape. As shown in FIG. 1, the body 21 is generally one half of a cylinder. The body 21 includes portions formed of alternating translucent and opaque materials. The body 21 is preferably fabricated from formed plastic, however, a wide variety of materials can be implement without detracting from the spirit of the invention. The body 21 and wall 24*a* form a cavity 22, FIG. 2, closed by a top wall 24*b* and in which a lighting source may be placed. A liquid 10, such as clear or colored water, is pooled in the basin 30 and is circulated from the basin 30 through the housing 20 by way of a suitable conduit 45, FIG. 2, to the top 100 where the liquid flows into a retainer or reservoir 47 and then down the outside of the body 21 and repooling in the basin 30. The flowing of the liquid 10 down over the body 21 provides a waterfall effect or a liquid curtain 10*a*. Thus, the waterfall lamp W provides an illuminated waterfall effect by flowing liquid 10 over the exterior of the body 21 while illuminating the body 21 with a light source within the cavity 22. Spaced apart opaque bands 26 of the body 21 do not allow for light to be passed through; however, alternate translucent bands 25 disposed between opaque bands 26 do allow for light to be passed through the body 21. Thus, the liquid curtain 10*a* flowing over the body 21 is illuminated from behind, thus providing the illuminated waterfall effect. In one embodiment, the translucent bands 25 include colored translucent bands. A wide variety of colors may be used in accordance with the invention. Thus, a clear translucent band may be implemented with a colored light source or with a white light source, for example. Bands 25 may be formed by a semi-cylindrical lens 25*a* disposed adjacent body 21 and closing spaced apart parallel slots 2*a*.

Figure 2:
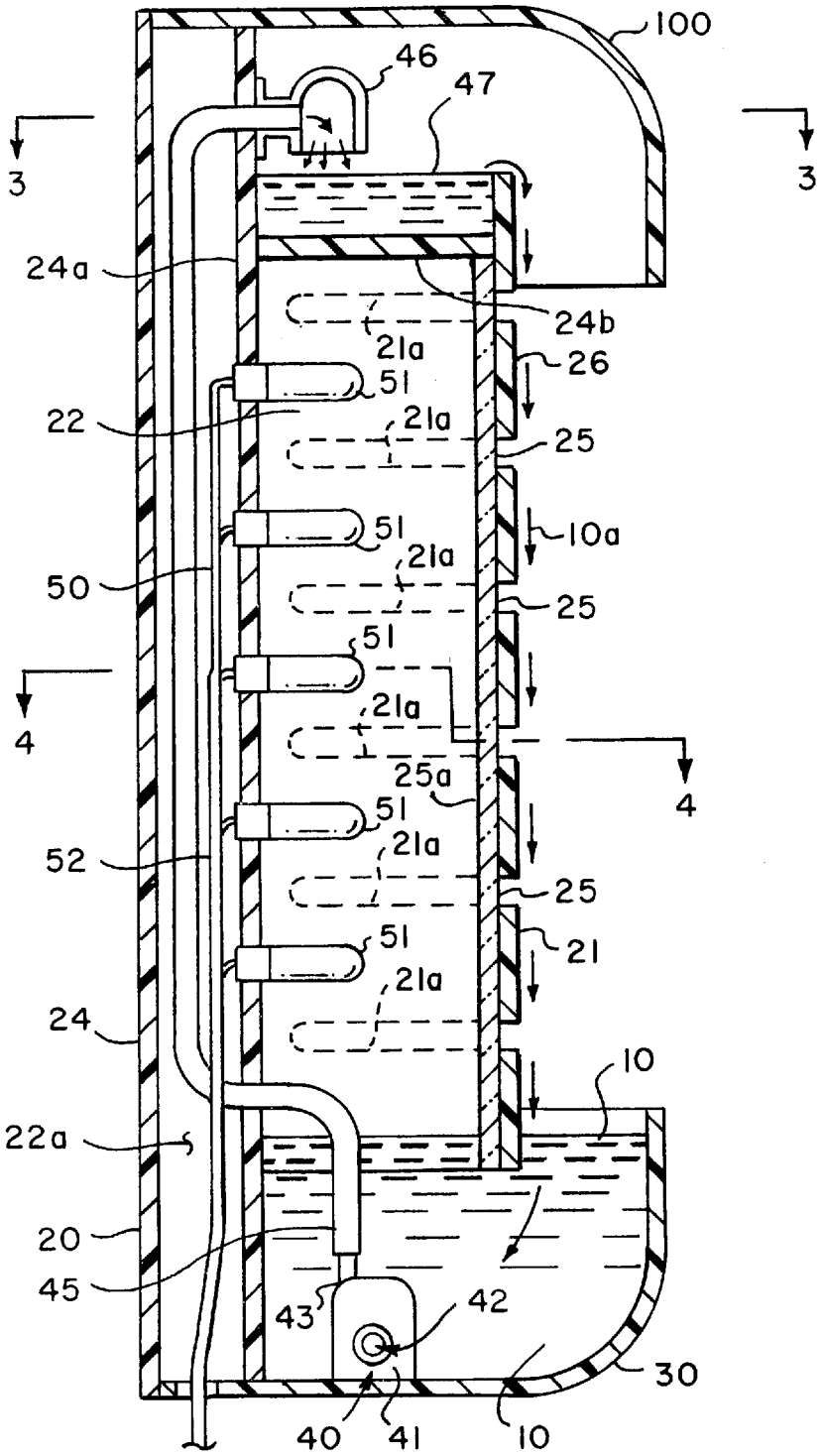
FIG. 2 is a section view taken substantially along the lines 2—2 of FIG. 1.
Figure 3:
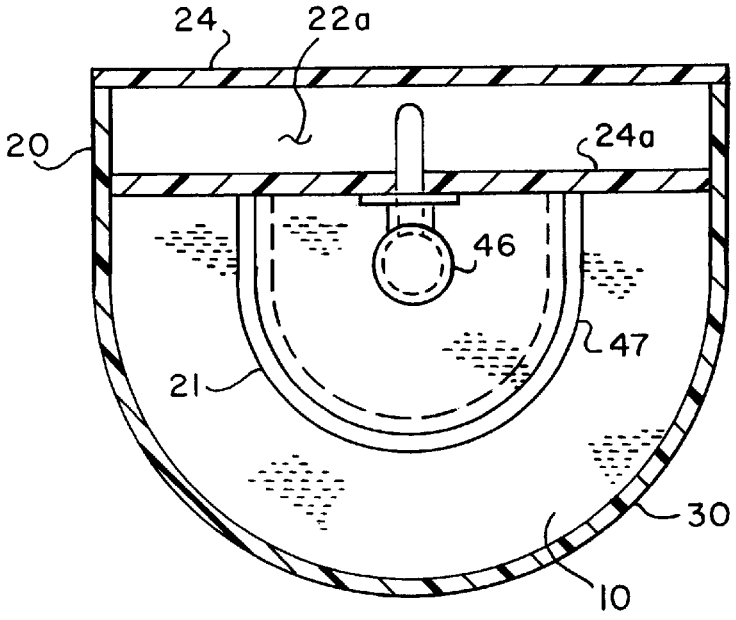
FIG. 3 is a section view taken substantially along the lines 3—3 of FIG. 2.
Figure 4:
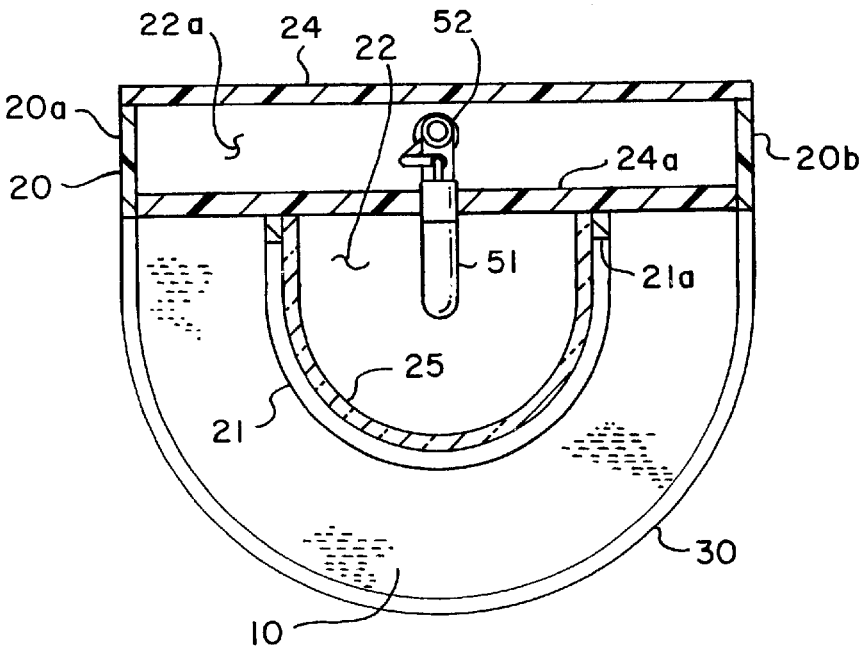
FIG. 4 is a section view taken substantially along the lines 4—4 of FIG. 2.

Referring to FIGS. 2, 3, and 4, back wall 24 is shown attached to the housing 20. The intermediate wall 24*a* forms one wall defining the half cylindrical cavity 22 in conjunction with the body 21 and top wall 24*b*. In an embodiment including the back wall 24, the light source and circulating apparatus may be included within the cavity 22. In another embodiment, a waterfall lamp W may be provided which does not include a back wall 24 and thus the lighting source and circulating apparatus may be placed behind the housing 20 or in the cavity 22. The cavity 22 would be formed by the body 21, basin 30, and top 100. The basin 30 as shown in FIGS. 1, 2, 3 and 4 is integral with the housing 20. However, the basin 30 can be attached, either fixedly or removably, with the housing 20 in alternate embodiments. The basin 30 provides an area for the liquid 10 to pool. Therefore, the liquid 10 remains in the basin 30, in the circulating apparatus, or is flowing along the outside of the body 21. The light source is included behind the body 21 or housing 20. Therefore, the light source and the liquid 10 are never in direct contact. Thus, the waterfall lamp W provides the appearance of a light source submerged in a liquid 10; however, the light source of the invention is contained in a separate area, and is never in direct contact with the liquid 10.

As shown in FIGS. 2, 3, and 4 the liquid 10 flows to the top of the housing 20 through a circulation assembly 40, FIG. 2, comprising a pump 41, an outflow conduit or line 45, and a nozzle or cap with filter 46, for circulating liquid to an upper liquid retainer 47. The outflow line 45 is routed from within the basin 30, through a portion of cavity 22, through wall 24*a* and cavity 22*a* formed between walls 24 and 24*a*. The outflow line continues upwardly to the top 100. The outflow line passes back through wall 24*a* and is attached to the cap with filter 46. However, the outflow line 45 may be routed in a wide variety of locations without detracting from the spirit of the invention, examples include routing the outflow line 45 through the back wall 24, imbedded within the back wall 24, passing the outflow line 45 through the housing 20 and then routed upwardly from behind the waterfall lamp to the top 100. The liquid 10 enters an inlet port 42 of the pump 41 and is pumped through an outlet port 43 into the outflow line 45, upwardly through the outflow line 45 through the cap with filter 46 positioned above the upper liquid retainer 47, and into the upper liquid retainer 47 positioned above the body 21. The liquid retainer 47 fills with the liquid 10 until the liquid 10 overflows and cascades down the outside of the body 21, forming the liquid curtain 10*a*, and returning to basin 30. The liquid 10 in the basin 30 enters the inlet port 42 of the pump 41, which causes the liquid 10 to recirculate through the liquid circulation assembly 40. The liquid retainer 47, in one disclosed embodiment, allows for the liquid 10 to pool in the liquid retainer 47 before overflowing and flowing down the body 21. However, a wide variety of circulating assemblies can be used without detracting from the spirit of the invention; examples include circulating the liquid 10 through the outflow line 45 which enters the top 100 and allows for the liquid 10 to directly flow down the body 21 into the basin 30.

Referring to FIGS. 2 and 4, a light source 50 is positioned inside the cavity 22. The light source 50 includes multiple electric lamps 51 connected to an electrical cord 52 that may in turn be connected to an external power source. The electric lamps 51, positioned behind the opaque bands 26 and translucent bands 25 of the body 21, illuminate the interior of the body 21. The translucent bands 25 transmit light through cascading liquid 10, which in turn transmits light, producing an appealing visual effect. The light source 50, however, may be provided by wide variety of light-producing apparatus without detracting from the spirit of the invention. For example, a single electric light may be provided as the sole light source for the waterfall lamp W, or a light source using indirect natural light may be provided, such that the natural light source provides the light which is transmitted through the body 21 and through the cascading liquid 10. The body 21 can further include a wide variety of materials of varying densities. Thus, materials of varying light density can be used separately or in conjunction with other light density materials to provide the effect of the waterfall lamp.

Figure 5:
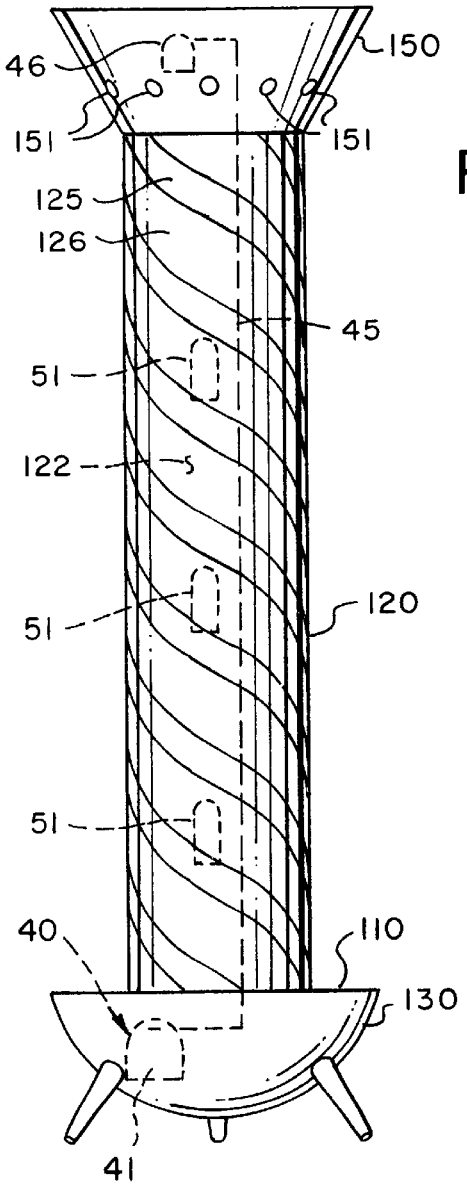
FIG. 5 is a front elevation of a second embodiment of the present invention.

Referring now to FIG. 5, an alternate embodiment of the waterfall lamp W is shown. In this embodiment, a basin 130 is shown in the general form of a bowl. A body 120 extends upwardly from the basin 130 to a top 150. The body 120 is cylindrical, thus forming a cavity 122 within the interior of the cylindrical shaped body 120. Alternating translucent bands 126 and opaque bands 125 are shown in a spiral design, thus resembling a barber pole pattern. In this embodiment, the liquid 110 pools in the basin 130 and is circulated through a circulation apparatus 40 through the cavity 122 to the top 150 out through ports 151 and flows down the outside of the cylindrical body 120 into the basin 130. Further, light source 51 is contained within the cavity 122, thus illuminating the translucent bands 126, which in turn luminate the flowing liquid 110, thus producing the waterfall lamp effect.

Figure 6:
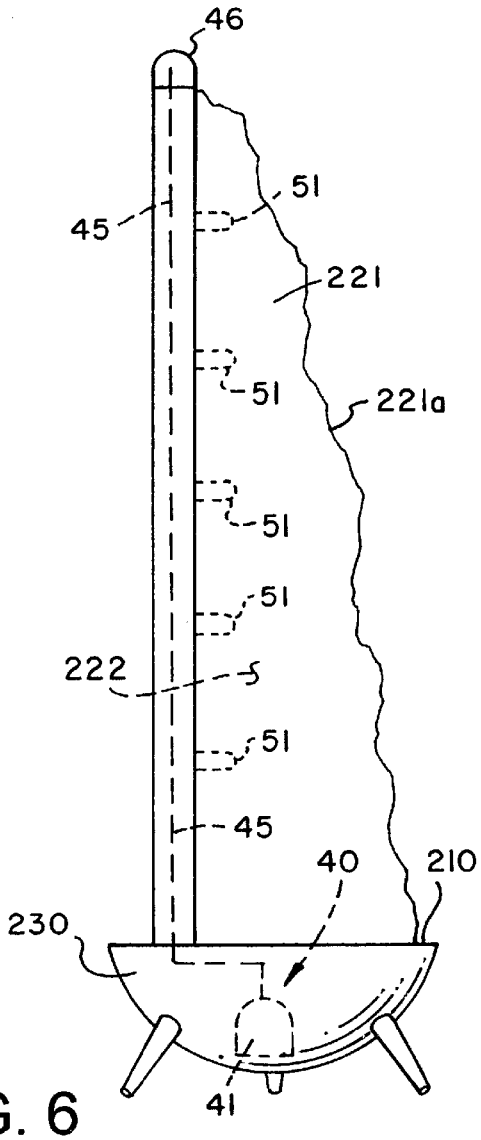
FIG. 6 is a side elevation of a third embodiment of the present invention.

Referring to FIG. 6, a second alternate embodiment of the disclosed invention is shown. In this embodiment, a basin 230 is shown which pools a liquid 210. A translucent body 221 extends upwardly from basin 230. The exterior surface 221*a* of the body 221 is formed to emulate a rock front. Thus, the body 221 is not comprised of standard shape, but follows a free-formed design. A cavity 222 is formed within the body 221 and is defined by the body 221 and basin 230. The cavity can include the lighting source 51 and circulating assembly 40. The circulating assembly 40 allows for the liquid 210 to be routed upwardly to the top of the body 221. However, no top is included in this embodiment. Therefore, the liquid is routed through the circulation assembly 40 to the top portion of the body 221 and the liquid 210 begins to flow directly onto the outside of the body 221 down into the basin 230. Multiple alternate forms of the illuminated waterfall lamp may be implemented without detracting from the spirit of the invention, including an outdoor fountain and a pyramid.

The foregoing disclosure and description of the invention are illustrative and explanatory thereof and various changes to the size, shape and materials and components may be made without departing from the spirit of the invention.

What is claimed is:

1. A decorative lighting device comprising:

a basin;

a housing with alternating opaque and translucent portions, the housing extending upwardly from the basin and comprising a top and a body, the top and body forming a cavity;

a light source including multiple electric lamps positioned inside the cavity behind the opaque and translucent portions of the housing, connected to an external power source and operable to project light through the translucent portions; and a liquid circulation assembly including a pump with an inlet port and an outlet port, an outflow line, a cap with a filter, and a liquid retainer; wherein the inlet port opens into the basin, the outlet port connects to the outflow line, the outflow line extends upwardly and connects to the cap with filter, the cap with filter is positioned above the liquid retainer, and the liquid retainer is positioned at the top of the housing, allowing the liquid to overflow the liquid retainer, cascade down the outside of the housing, while transmitting light produced by the light source and transmitted by the translucent portions, fall into the basin, and recirculate through the inlet port, the pump, the outlet port, the outlet line, and the cap with filter.

2. A decorative lighting device comprising:

a basin;

a housing extending upwardly from the basin, the housing comprising a body forming a cavity, the body comprising alternating opaque and translucent portions;

a lighting means behind the body, the lighting means illuminating the translucent portions; and a circulating means for circulating a liquid from the basin upwardly to the top of the body, wherein the liquid flows down the outside of the body, while transmitting light produced by the lighting means and transmitted by the translucent portions, and back into the basin.

3. A decorative lighting device comprising:

a basin;

a housing extending upwardly from the basin, the housing comprising a body forming a cavity, the body comprising translucent portions and opaque portions;

a lighting means behind the body, the lighting means illuminating the translucent portions; and a circulating means for circulating a liquid from the basin upwardly to the top of the body, wherein the liquid flows down the outside of the body, while transmitting light produced by the lighting means and transmitted by the translucent portions, and back into the basin.

4. The decorative lighting device according to claim 3 wherein the translucent portions and opaque portions are a barber pole design.

5. The decorative lighting device according to claim 3 wherein the translucent portions and opaque portions are repeating bands.

* * * * *